US008151726B2

(12) United States Patent
Cossaboom

(10) Patent No.: US 8,151,726 B2
(45) Date of Patent: Apr. 10, 2012

(54) TRAPHOUSE SAFETY FLAG

(76) Inventor: Jere L. Cossaboom, Bridgeton, NJ (US)

( * ) Notice: Subject to any disclaimer, the term of this patent is extended or adjusted under 35 U.S.C. 154(b) by 833 days.

(21) Appl. No.: 12/289,521

(22) Filed: Oct. 29, 2008

(65) Prior Publication Data

US 2010/0101483 A1 Apr. 29, 2010

(51) Int. Cl.
*G01D 13/00* (2006.01)

(52) U.S. Cl. ..... 116/303; 116/2; 116/173; 116/200; 116/209; 116/284; 340/984; 340/815.64; 340/815.78; 340/815.86; 124/1; 124/8; 124/9; 124/32

(58) Field of Classification Search ..... 116/2, 173, 116/200, 209, 284, 303; 124/1, 8, 9, 32; 340/984, 815.64, 815.78, 815.86
See application file for complete search history.

(56) References Cited

U.S. PATENT DOCUMENTS

| | | | | | |
|---|---|---|---|---|---|
| 1,794,014 | A | * | 2/1931 | Gutierrez | 116/46 |
| 1,817,786 | A | * | 8/1931 | Van Antwerp | 124/54 |
| 2,271,126 | A | * | 1/1942 | Marcus et al. | 340/484 |
| 2,540,394 | A | * | 2/1951 | Hollingsworth | 116/52 |
| 2,653,405 | A | * | 9/1953 | Monahan | 43/16 |
| 2,784,692 | A | * | 3/1957 | Ballesteros | 116/28 R |
| 2,855,916 | A | * | 10/1958 | Foster | 124/32 |
| 2,936,179 | A | * | 5/1960 | Thurston | 473/194 |
| 3,376,844 | A | * | 4/1968 | Wood | 116/223 |
| 3,494,321 | A | * | 2/1970 | Moore et al. | 116/221 |
| 3,568,199 | A | * | 3/1971 | Hartness | 340/12.5 |
| 3,612,025 | A | * | 10/1971 | Rhodes | 124/9 |
| 3,680,863 | A | * | 8/1972 | Wallace et al. | 273/362 |
| 3,735,724 | A | * | 5/1973 | Miller | 116/303 |
| 3,739,373 | A | * | 6/1973 | Liming et al. | 340/309.8 |
| 3,798,631 | A | * | 3/1974 | Langford | 340/502 |
| 3,821,945 | A | * | 7/1974 | Foster | 124/9 |
| 3,848,244 | A | * | 11/1974 | Young et al. | 340/665 |
| 3,923,033 | A | * | 12/1975 | Laporte et al. | 124/8 |
| 3,967,575 | A | * | 7/1976 | Coutts | 116/35 A |
| 3,968,928 | A | * | 7/1976 | Caldwell | 232/35 |
| 4,038,935 | A | * | 8/1977 | Margiloff | 116/35 R |
| 4,052,697 | A | * | 10/1977 | Daifotes | 340/472 |

(Continued)

FOREIGN PATENT DOCUMENTS

JP 2004188054 7/2004

OTHER PUBLICATIONS

Red round flag by dreamstime, 2 pages printed from the Internet, Aug. 15, 2008, http://www.dreamstime.com/round-flaq-of-st.-kitts-&-nevis-image4909206.

*Primary Examiner* — Gene Kim
*Assistant Examiner* — Alexander Niconovich
(74) *Attorney, Agent, or Firm* — Richard C. Litman

(57) ABSTRACT

The traphouse safety flag is an electromechanical safety device mounted at the roofline of a traphouse intended to replace the traditional safety cone or cloth flag that is commonly used to indicate to the shooters that the traphouse is occupied and shooting cannot commence. A "no flag" detent position energizes the normal trap shooting control mechanism while indicating to the shooters that the traphouse and personnel are secure. The safety flag obscures the entrance to the traphouse in a shooting position and if the flag is moved out of the no flag detent position for any reason, the trap shooting control mechanism is deactivated and will not accept a launch command from the shooter.

1 Claim, 6 Drawing Sheets

U.S. PATENT DOCUMENTS 4,116,154 A * 9/1978 Harris ..... 116/35 A
4,181,911 A * 1/1980 Black ..... 342/386
4,201,181 A * 5/1980 Becker ..... 124/6
D255,226 S 6/1980 Daniels
4,205,651 A * 6/1980 Lante-Montefeltro Della Rovere ..... 124/1
4,321,883 A * 3/1982 Ruppa ..... 116/35 A
4,482,325 A 11/1984 Reimann
4,565,152 A * 1/1986 Bennett ..... 116/50
4,596,204 A * 6/1986 Ralls ..... 116/303
4,599,965 A * 7/1986 Johnson ..... 116/209
4,640,213 A * 2/1987 Lugo ..... 114/253
4,648,596 A * 3/1987 Long ..... 473/419
4,664,094 A * 5/1987 Hurlimann ..... 124/54
4,706,641 A * 11/1987 Cote et al. ..... 124/8
4,782,784 A * 11/1988 Little ..... 116/303
4,831,996 A * 5/1989 Cero ..... 124/8
4,934,972 A * 6/1990 Shumway et al. ..... 441/69
4,967,720 A 11/1990 McCord et al.
4,976,249 A * 12/1990 Gagnon ..... 124/8
5,029,551 A * 7/1991 Rosen ..... 116/209
5,038,136 A * 8/1991 Watson ..... 340/480
5,359,576 A * 10/1994 Bunner et al. ..... 367/197
5,406,250 A * 4/1995 Reavell et al. ..... 340/433
5,406,928 A 4/1995 Panara et al.
5,427,380 A * 6/1995 Hazard et al. ..... 273/362
5,529,310 A * 6/1996 Hazard et al. ..... 273/362
5,540,181 A * 7/1996 Pearce ..... 116/173
5,550,531 A * 8/1996 Little-Lowry ..... 340/573.6
5,771,836 A * 6/1998 Crouse ..... 116/209
D406,781 S 3/1999 Williams
6,057,787 A * 5/2000 Kell et al. ..... 340/984
6,129,549 A * 10/2000 Thompson ..... 434/16
6,250,248 B1 * 6/2001 Patera ..... 116/209
6,267,494 B1 * 7/2001 Burch ..... 366/41
6,318,350 B1 * 11/2001 Williams ..... 124/71
6,337,623 B1 * 1/2002 Krugh et al. ..... 340/472
6,374,766 B1 * 4/2002 Clark ..... 116/28 R
6,584,927 B1 * 7/2003 Iversen et al. ..... 116/173
6,679,239 B1 * 1/2004 Shultz et al. ..... 124/16
D487,566 S 3/2004 Oliveras
6,854,729 B2 2/2005 Yamaguchi
6,932,022 B1 * 8/2005 Keller et al. ..... 116/209
6,962,126 B1 * 11/2005 Payson ..... 116/303
7,059,690 B1 * 6/2006 Pinkston ..... 303/122.15
7,428,879 B1 * 9/2008 White et al. ..... 116/303
7,546,815 B2 * 6/2009 Mazzei et al. ..... 116/303
2005/0252439 A1 * 11/2005 Payson ..... 116/303
2006/0065258 A1 * 3/2006 Lovell ..... 124/9
2007/0023022 A1 * 2/2007 Lentz ..... 124/8
2008/0000412 A1 * 1/2008 Mazzei et al. ..... 116/303
2008/0035049 A1 * 2/2008 Johnston et al. ..... 116/173
2011/0140925 A1 * 6/2011 McDonald ..... 340/984

* cited by examiner

TRAPHOUSE SAFETY FLAG

BACKGROUND OF THE INVENTION

1. Field of the Invention

The present invention relates to a trap loader safety flag and, more particularly, to such a flag in which a lowered position of the flag renders a throwing machine operative, the lowered flag position indicating that a shooter is free to commence clay pigeon shooting.

2. Description of the Related Art

In the sport of trapshooting, a squad of five participants shoot at clay targets launched from a trap that is housed in a small enclosure called a traphouse. The traphouse in a trap pit is generally constructed such that the top of its roof is on the same elevation as the surface of the shooting stations. Interior dimensions of the traphouse are sufficient for the launching equipment and an operator to safely reside in during shooting. The traphouse dimensions generally allow freedom of movement of working personnel and sufficient storage space for competition targets.

The traphouse enclosure is partially below the surface of the ground so as to locate the launch point of the target at the level of the walkway on which the shooters stand. During the period of time in which the trap is in use it must be periodically loaded with targets, cleaned of broken target debris and adjusted to launch the targets at the proper distance and height In order to perform these services, an attendant must manually de-activate the trap and enter the traphouse.

A major concern, however, is safety in and around the traphouse. Traditionally, a safety cone or cloth flag is used to indicate to the shooters that the traphouse is occupied and shooting cannot commence.

A "no flag" condition indicates to the shooters that the traphouse and personnel are secure. It is customary that when an attendant enters the traphouse he/she places a safety cone or flag on the roof to indicate that the house is occupied and no shooting is to take place. In the event that the trap has not been properly de-activated because of time constraints, poor training or just hazardous work on the attendants' part, the attendant is exposed to the possibility of an accidental target release. An accidental release of energy can cause serious injury to the attendant or another person who may be working with him/her to make the loading faster during a trapshooting competition. It is also possible that if the attendant, for some reason, does not place the safety cone or flag on the roof that shooting could commence without the attendant's knowledge. If he/she attempts to exit the traphouse they could be exposed to gunfire from the participants who are not aware of the attendant.

The trap attendant must manually place the cone on the traphouse roof, if he/she remembers to do so, and before he/she enters, must disconnect power to the trap control and launch the last target to release all stored energy. Provided that the operator remembers to perform the aforementioned steps, then and only then is the traphouse safe to enter. Today at most clay target shoots, the trap attendants are young persons of high school age that have had minimal training and, if any, usually by another young person of questionable teaching ability. The lack of experience in traphouse operations leads to an increasing probability that the operator may forget an essential traphouse safety step.

Thus, a traphouse safety flag solving the aforementioned problems is desired.

SUMMARY OF THE INVENTION

The traphouse safety flag is an electromechanical safety device mounted at the roofline of a traphouse intended to replace the traditional safety cone or cloth flag that is commonly used to indicate to the shooters that the traphouse is occupied and shooting cannot commence.

A "no flag" detent position indicates to the shooters that the traphouse and personnel are secure. The safety flag obscures the entrance to the traphouse in a shooting position and if the flag is moved out of the no flag detent position for any reason, the trap shooting control mechanism is deactivated and will not accept a launch command from the shooter.

In operation, when the flag is in a down position, all systems are operating and the trap is ready to accept a launch command from the firing line. Entry or exit from the traphouse is all but impossible as it partially blocks the entry location. When the flag is moved in a clockwise direction to an upright detent position, it disconnects all power to the trap controller and interrupts commands from the firing line.

When the flag reaches approximately ninety degrees, it releases the last target that was loaded and renders the trap safe with all stored energy released. When the attendant is finished loading the trap, the flag is turned in a counterclockwise motion back to the down position. Power is restored to the trap controls and a target is loaded ready for a launch. In the event that the trap must be activated for the purpose of maintenance or adjustment while the traphouse is occupied, the flag is moved an additional forty five degrees clockwise. During this period of time, the trap is controlled by the inside switches.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

As shown in FIGS. 1-5, the traphouse safety flag includes a rotatable safety flag and mast 10 attached to a housing 12 mounted at the roofline of a traphouse T. The traphouse safety flag 10 is intended to replace a traditional safety cone or cloth flag commonly used to indicate to the shooters that the traphouse T is occupied and shooting cannot commence. All trap house operations are controlled by an electrical control system. The safety flag 10 taps into the trap house operations electrical control system to provide a fail-safe process of trap house activation/deactivation, depending upon physical angular positioning of the safety flag and mast 10.

Figure 1:
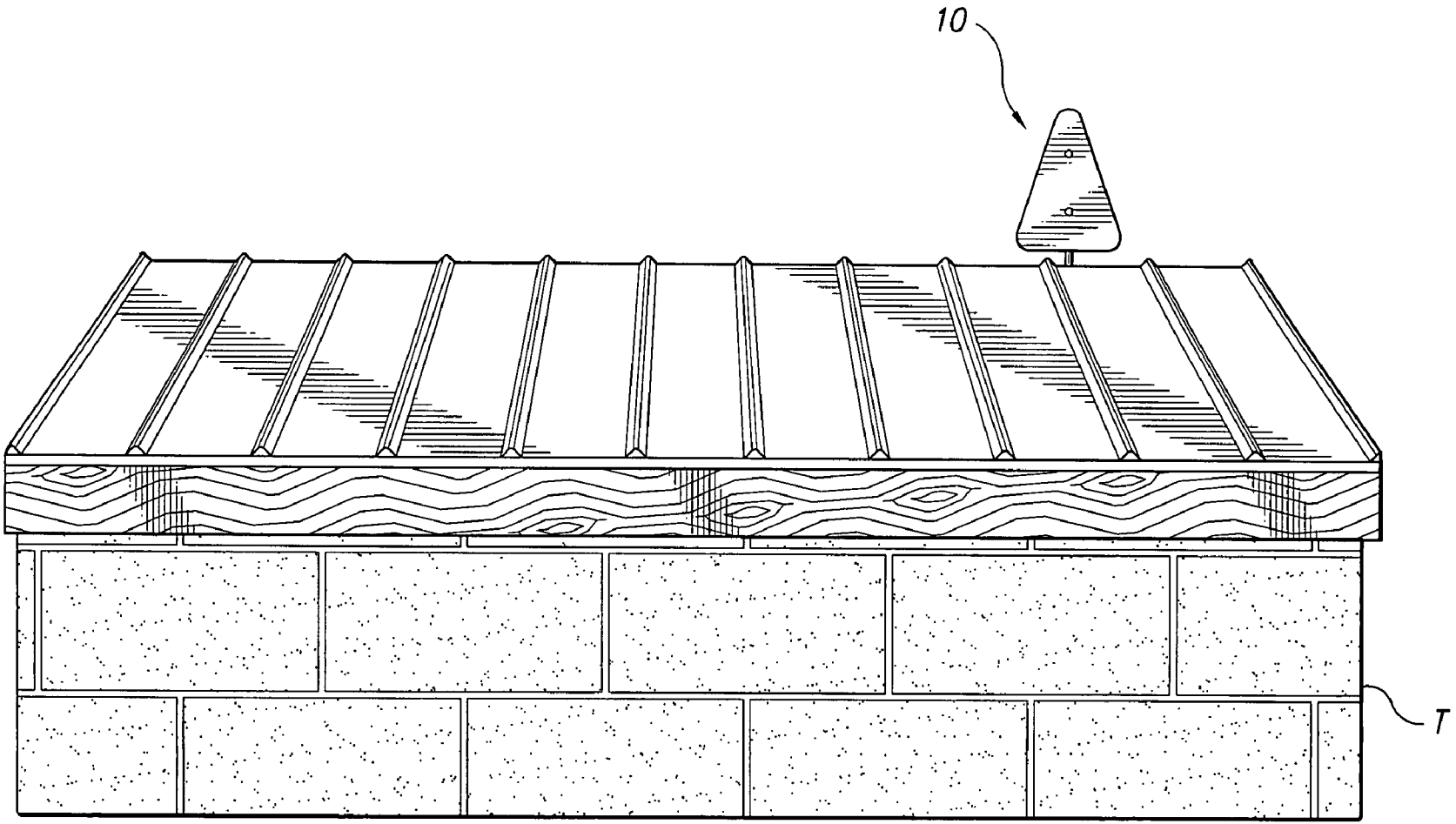
FIG. 1 is an environmental front perspective view of a traphouse safety flag showing a raised position according to the present invention.
Figure 2:
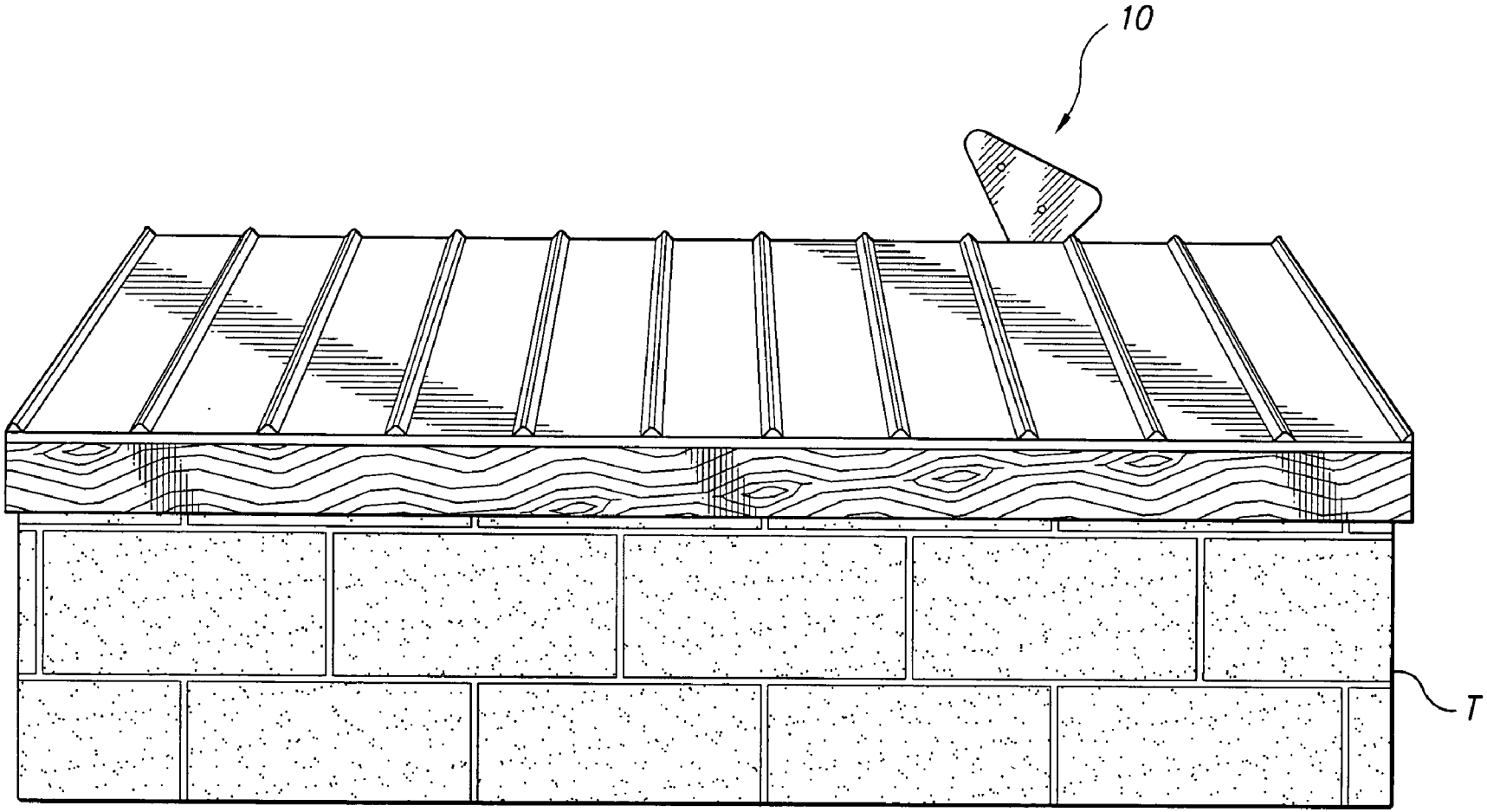
FIG. 2 is an environmental front perspective view of a traphouse safety flag according to the present invention, showing an intermediate position.
Figure 3:
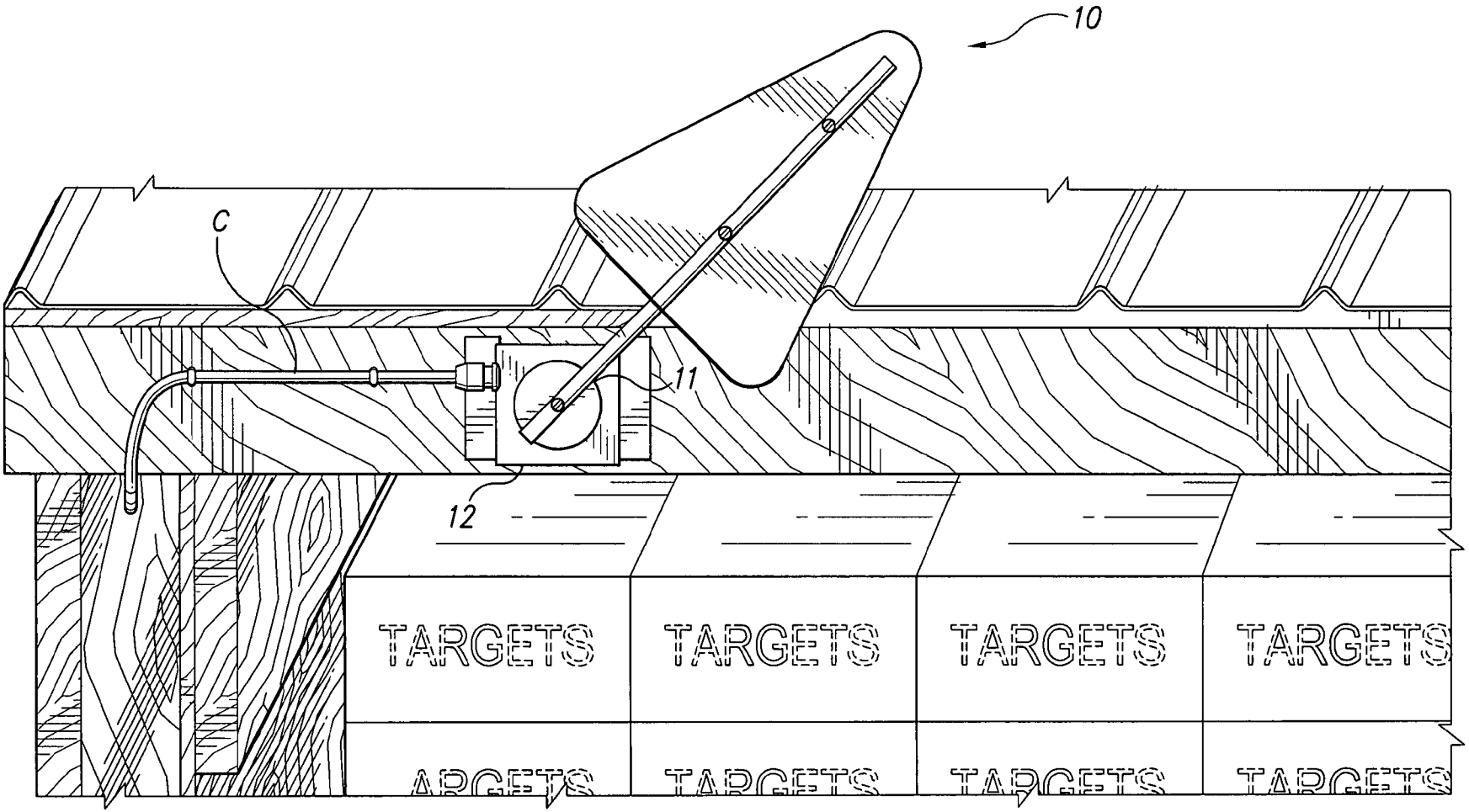
FIG. 3 is an environmental rear perspective view of a traphouse safety flag according to the present invention, showing an intermediate position.
Figure 4:
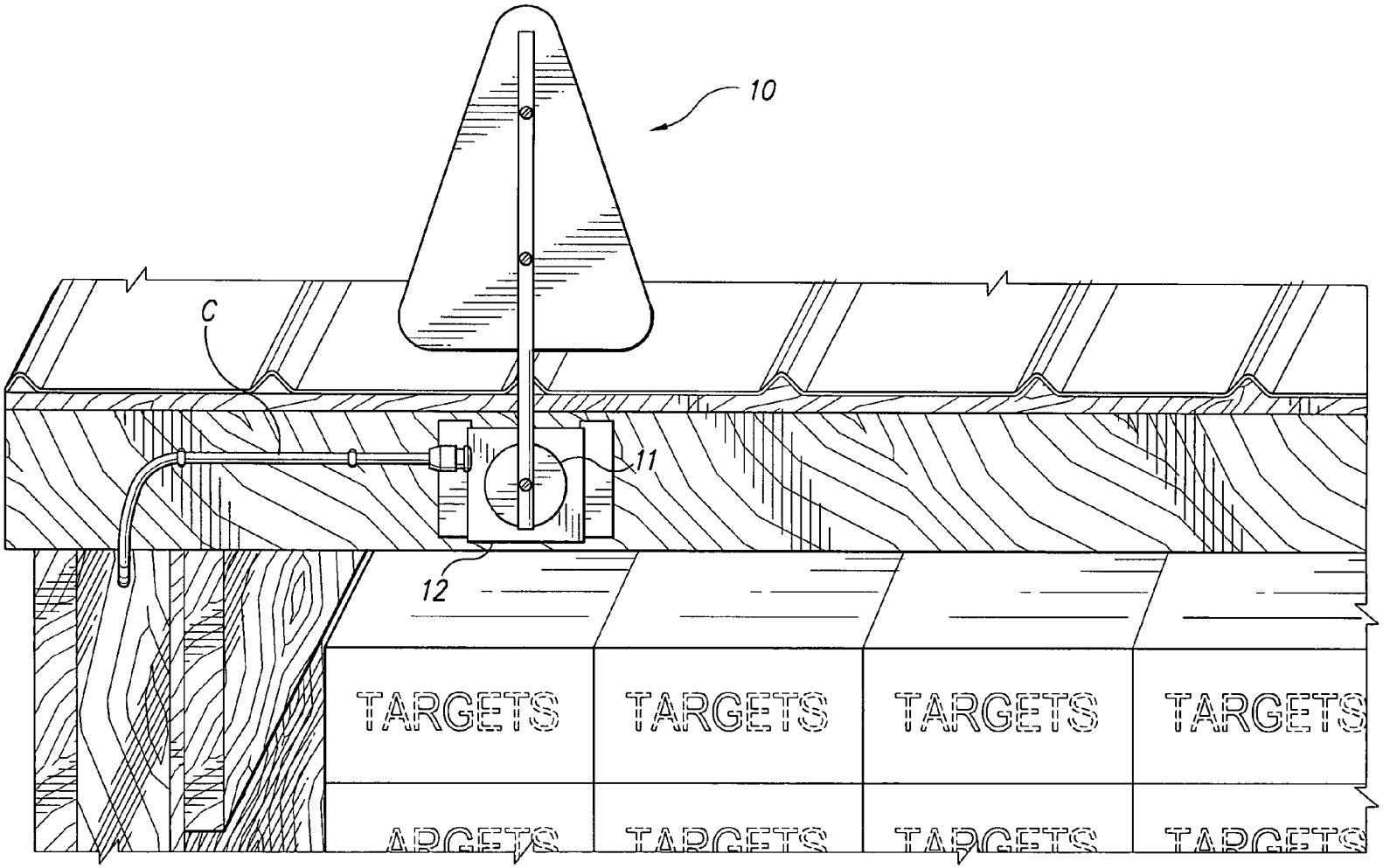
FIG. 4 is an environmental rear perspective view of a traphouse safety flag according to the present invention, showing a raised position.
Figure 6:
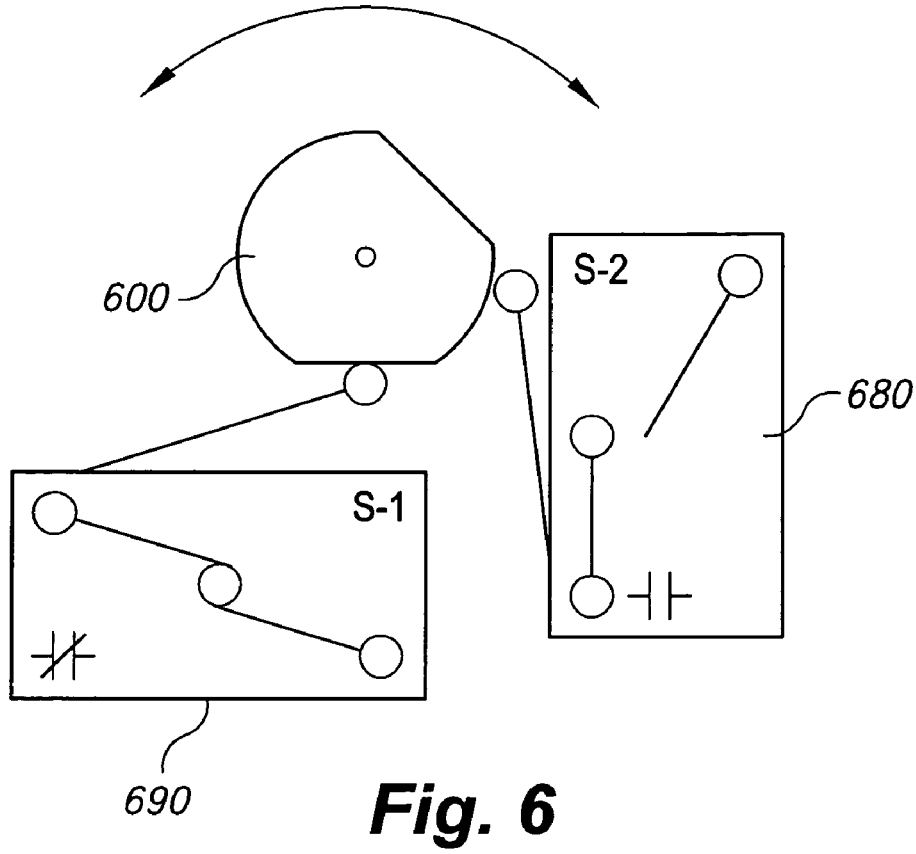
FIG. 6 is a block diagram of the cam and switch arrangement of a traphouse safety flag according to the present invention.

Referring to FIGS. 3 and 6, the flag's mast 10 is attached to a circular bearing plate 11 that is attached to the end of a rotary cam 600. The rotary cam is disposed in the housing 12, the circular bearing plate 11 rotating in a hole defined in the wall of the housing 12. As most clearly shown in FIG. 6, a first limit switch 690 and a second limit switch 680 are each positioned in operative connection with the cam 600 to cause the trap house operations to sequence from a safe inoperative mode to a live fire mode of operation.

Switch 690 is a normally closed switch. When switch 690 is in a closed state, power is supplied to the trap control circuit (the flat face of the cam lobe permitting switch 690 to remain in the normally closed position), and the lobe of the cam bears against switch 680 to keep switch 680 in an open position. When switch 680 is in an open state, power to the trap launch relay is interrupted. As the flag 10 is moved out of detent, the cam 600 rotates so that the lobe bears against switch 690, opening switch 690, while the flat lateral face of the cam faces switch 680, permitting switch 680 to close. When switch 690 is open, power is removed from the control circuit. Simultaneously, switch 680 is closed, causing power to be applied through the trap launch relay 680 to launch the last target and place the traphouse launcher in a safe mode.

When a user places the flag 10 in an upright position, all power is removed from the control circuit, the last target having been launched to thereby release all stored energy from the traphouse launching mechanism. Wiring from the traphouse electrical control system to switches 680 and 690 extends through protective conduit C.

Figure 5:
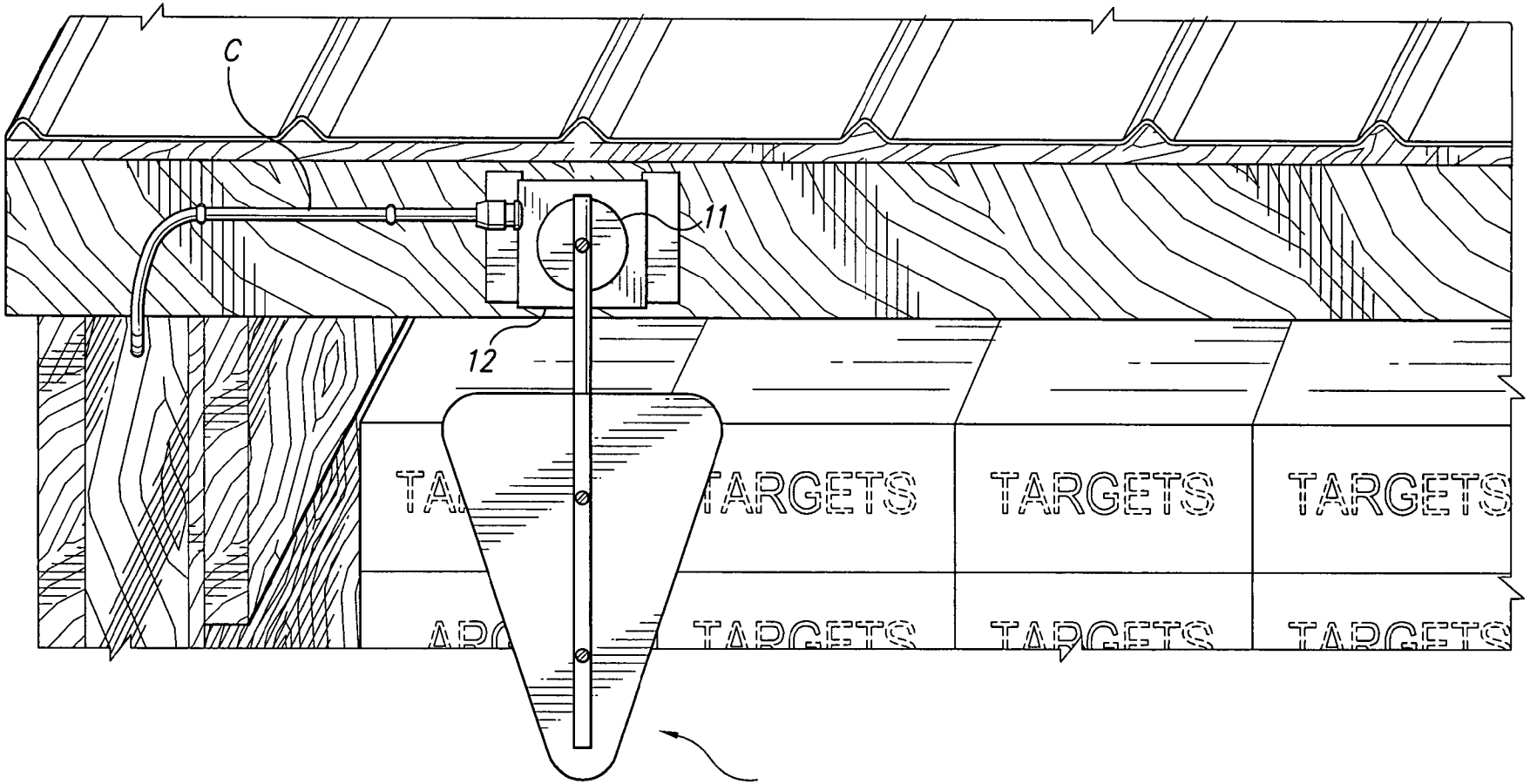
FIG. 5 is an environmental perspective view of a traphouse safety flag according to the present invention, showing a lowered position.

As shown in FIG. 5, the flag mechanism has a "no flag" detent position in which the flag is hidden from shooters, a condition that indicates to the shooters that the traphouse and personnel are secure. In the "no flag" detent position, the safety flag obscures the entrance to the traphouse while activating the clay pigeon shooting equipment. If the flag is moved for any reason, the flag mechanism deactivates the clay pigeon launching equipment so that the clay pigeon launching equipment will not accept a launch command from the shooter.

Figure 7:
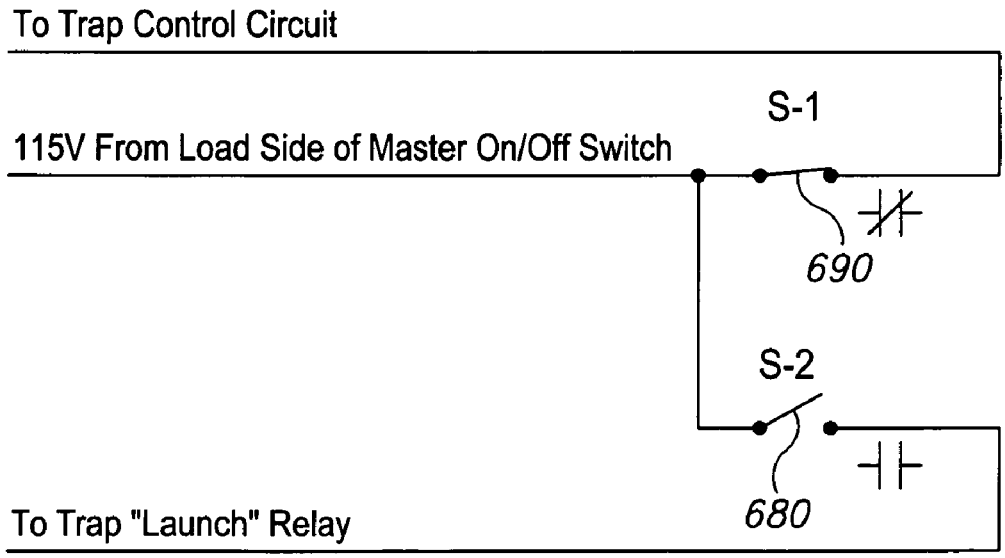
FIG. 7 is a schematic diagram showing the switch wiring of a traphouse safety flag according to the present invention.

In operation, when the flag is in a down position (0°), configuration of limit switches 680, 690 in operable communication with the rotating cam 600 attached to the flag mechanism 10 places all trap launching systems in an operable mode and the trap is ready to accept a launch command from the firing line. In the flag down position, i.e., 0° angular displacement, entry or exit from the traphouse is all but impossible as the safety flag 10 partially blocks the entry location. It should be understood, as shown in FIG. 7, that the first limit switch 690 interconnects a voltage supply line to a trap control circuit when switch 690 is closed, and that the second limit switch 680 interconnects the voltage supply line to a trap launch relay when switch 680 is closed.

When the flag 10 is moved in a clockwise direction to an upright detent position (180° from the flag down position), configuration of the limit switches 680, 690 in operable communication with the rotating cam 600 attached to the flag mechanism 10 disconnects all power to the trap controller and the command from the firing line.

When the flag 10 reaches approximately 90° angular displacement, configuration of the limit switches 680, 690 in operable communication with the rotating cam 600 attached to the flag mechanism 10 disarms the traphouse equipment by causing the last target that was loaded in the trap launching machinery to be released, thereby rendering the trap safe with all stored energy released. When the attendant is finished loading the trap, the flag is turned in a counterclockwise motion back to the down position (0°).

Configuration of the limit switches 680, 690 restores power to the trap controls, and a target is loaded ready for a launch. In the event that the trap must be activated for the purpose of maintenance or adjustment while the traphouse is occupied, the flag is moved to a 45° angular displacement position. The switch configuration associated with the 45° angular displacement position allows the trap to be controlled by the normal traphouse equipment.

It is to be understood that the present invention is not limited to the embodiment described above, but encompasses any and all embodiments within the scope of the following claims.

I claim:

1. An electromechanical traphouse safety flag apparatus adapted to be mounted to a roofline of a traphouse and to be operatively connected to voltage supply lines of traphouse launching circuits in order to respond to a remote launch commands from a shooter on a firing line, comprising:

a mast, a rotary cam connected to the mast and adapted to be mounted to the traphouse, a flag mounted on the mast and adapted to be angularly displaced by movement of the cam; and;

trap launching system electronic control circuitry adapted for electrical communication with the traphouse launching circuits, thereby activating, deactivating and disarming the traphouse launching circuits depending upon the position of the cam and the angular displacement of the flag on the traphouse, the electronic control circuitry having a plurality of switches in contact with the cam, the switches opening and closing responsive to the angular displacement of the cam, the switches being electrically connected to the traphouse launching circuits, wherein a first switch of the plurality of switches is adapted for interconnecting a voltage supply line to a trap control circuit of the traphouse launching circuits, a second switch of the plurality of switches is adapted for interconnecting a voltage supply line to a trap launch relay of the traphouse launching circuits, wherein the flag has a first angular displacement position relative to the traphouse roofline in which the electronic control circuitry is configured for enabling all trap launching systems in an operable mode and enabling the trap launching system to accept a launch command from a shooter on a firing line, a second distinct angular displacement position relative to the traphouse roofline in which the control circuitry is configured for disconnecting all power to the trap launching circuitry and disabling a launch command from a shooter on a firing line, and at least one selective intermediate distinct angular displacement position relative to the traphouse roofline in which the electronic control circuitry is configured for disarming the traphouse control circuits.

* * * * *